US009079750B2

(12) United States Patent
Endo

(10) Patent No.: US 9,079,750 B2
(45) Date of Patent: Jul. 14, 2015

(54) ELEVATOR RENOVATION METHOD INCLUDING A RELAY PANEL

(75) Inventor: Takamasa Endo, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 869 days.

(21) Appl. No.: 13/264,054

(22) PCT Filed: Jun. 29, 2009

(86) PCT No.: PCT/JP2009/061867
§ 371 (c)(1),
(2), (4) Date: Oct. 12, 2011

(87) PCT Pub. No.: WO2011/001495
PCT Pub. Date: Jan. 6, 2011

(65) Prior Publication Data

US 2012/0023722 A1 Feb. 2, 2012

(51) Int. Cl.
*B66B 1/28* (2006.01)
*B66B 1/24* (2006.01)
*B66B 19/00* (2006.01)

(52) U.S. Cl.
CPC ..... *B66B 1/2458* (2013.01); *B66B 19/007* (2013.01); *B66B 2201/102* (2013.01); *B66B 2201/103* (2013.01); *Y10T 29/4973* (2015.01)

(58) Field of Classification Search
CPC ..... B66B 1/2458; B66B 19/007; B66B 2201/102; B66B 2201/103; Y10T 29/4973
USPC ..... 187/247, 248, 380–388, 391–393
See application file for complete search history.

(56) References Cited

U.S. PATENT DOCUMENTS 4,844,204 A * 7/1989 Ovaska et al. ..... 187/247
5,352,857 A * 10/1994 Ovaska ..... 187/247
5,357,064 A * 10/1994 Boyce et al. ..... 187/247
5,389,748 A * 2/1995 Burke et al. ..... 187/247

(Continued)

FOREIGN PATENT DOCUMENTS

JP 2-95684 A 4/1990
JP 02 147578 6/1990

(Continued)

OTHER PUBLICATIONS

International Search Report issued Sep. 15, 2009 in PCT/JP09/061867 filed Jun. 29, 2009.

(Continued)

*Primary Examiner* — Anthony Salata
(74) *Attorney, Agent, or Firm* — Oblon, McClelland, Maier & Neustadt, L.L.P.

(57) ABSTRACT

A method for renovating an existing elevator includes connecting a new group supervising apparatus that is connected to new landing operating panels to an existing elevator controlling apparatuses by a relaying apparatus that includes a relay panel and an input/output panel to enable existing elevator cars to be operated by the new group supervising apparatus. The existing group supervising apparatus is removed with the landing operating panels. New elevator cars and new elevator controlling apparatuses are substituted for the existing elevator controlling apparatuses together with the existing elevator cars. The new elevator controlling apparatuses are connected to the relaying apparatus to enable the new elevator cars to be operated by the new group supervising apparatus. The renovating method enables substitution of a new system of group supervised elevators without losing overall elevator service during a refurbishment transition period, and enables an elevator to be refurbished without losing elevator operating efficiency.

4 Claims, 3 Drawing Sheets

(56) References Cited

U.S. PATENT DOCUMENTS

| | | | | |
|---|---|---|---|---|
| 6,062,343 | A * | 5/2000 | Wang | 187/247 |
| 6,892,861 | B2 * | 5/2005 | Friedli | 187/247 |
| 7,900,750 | B2 * | 3/2011 | Mattsson et al. | 187/247 |
| 7,918,318 | B2 * | 4/2011 | Friedli et al. | 187/247 |
| 8,172,043 | B2 * | 5/2012 | Hughes et al. | 187/382 |
| 8,517,149 | B2 * | 8/2013 | Flynn et al. | 187/247 |
| 8,662,255 | B2 * | 3/2014 | Flynn et al. | 187/247 |
| 2008/0149432 | A1 | 6/2008 | Friedli et al. | |
| 2012/0193169 | A1 * | 8/2012 | Mizon | 187/247 |
| 2014/0174861 | A1 * | 6/2014 | Sarjanen et al. | 187/387 |

FOREIGN PATENT DOCUMENTS

| | | |
|---|---|---|
| JP | 4-266368 | 9/1992 |
| JP | 9-278313 | 10/1997 |
| JP | 2008 156117 | 7/2008 |
| JP | 2009 46284 | 3/2009 |
| JP | 2010 179998 | 8/2010 |
| WO | WO 2009068725 A1 * | 6/2009 |

OTHER PUBLICATIONS

Notification of Reason for Rejection issued Jul. 2, 2013 in Japanese Patent Application No. 2011-520688 (with English translation).

Combined Chinese Office Action and Search Report issued Aug. 1, 2013, in Chinese Patent Application No. 200980159507.9 with English translation and English translation of category of cited documents.

The Extended European Search Report issued Dec. 5, 2014, in Application No. / Patent No. 09846788.9-1705 / 2450303.

* cited by examiner

ELEVATOR RENOVATION METHOD INCLUDING A RELAY PANEL

TECHNICAL FIELD

The present invention relates to an elevator renovating method, and relates particularly to an elevator renovating method that can be used in an existing elevator apparatus that has a plurality of cars that are managed as a group.

BACKGROUND ART

At twenty years or more, elevator product life is long, but various technologies improve during that time. Energy is saved in elevators also by new technology being developed, user convenience is improved by new elevator features, etc., and user waiting time is shortened by improvements in elevator operating efficiency, etc., generating demand to renovate elevators. When elevators are refurbished, there is also demand for refurbishing to be done without losing elevator operating efficiency during refurbishment transition periods.

As an elevator refurbishing method that has been proposed to meet these requirements, it has been proposed that a device for connecting an existing group supervisory device and a new group supervisory device be used-when refurbishing so as to minimize deterioration in overall elevator services when replacing an existing elevator with a new elevator (see Patent Literature 1, for example).

CITATION LIST

Patent Literature

Patent Literature 1: Japanese Patent Laid-Open No. 2008-156117

SUMMARY OF THE INVENTION

Problem to be Solved by the Invention

However, even using this refurbishing method, it is necessary to stop group supervising functions for a certain period of time during refurbishment transition in order to connect the existing group supervisory device to the new group supervisory device, and there have been disadvantages such as elevator operating efficiency being reduced.

Consequently, an object of the present invention is to provide an elevator renovating method that can be applied to existing elevator apparatuses that have a plurality of cars that are managed as a group, and that enables deterioration in elevator operating efficiency to be kept to a minimum.

Means for Solving the Problem

In order to achieve the above object, according to one aspect of the present invention, there is provided an elevator renovating method for renovating an existing elevator including: an existing group supervising apparatus that is connected to a plurality of landing operating panels; and a plurality of existing elevator cars that are connected to respective existing elevator controlling apparatuses that are connected to the existing group supervising apparatus, the elevator renovating method being characterized in including steps of: connecting a new group supervising apparatus that is connected to new landing operating panels to the existing elevator controlling apparatuses by means of a relaying apparatus that includes a relay panel and an input/output panel so as to enable the existing elevator cars to be operated by the new group supervising apparatus, and removing the existing group supervising apparatus together with the landing operating panels; and substituting new elevator cars and new elevator controlling apparatuses for the existing elevator controlling apparatuses together with the existing elevator cars, and connecting the new elevator controlling apparatuses to the new group supervising apparatus so as to enable the new elevator cars to be operated by the new group supervising apparatus.

Effects of the Invention

According to the present invention, an elevator renovating method is provided that enables substitution of a new system of group supervised elevators without losing overall elevator service during a refurbishment transition period, and that enables an elevator to be refurbished without losing elevator operating efficiency.

DESCRIPTION OF EMBODIMENTS

A preferred embodiment of the present invention will now be explained.

Inventive Example 1

Figure 1:
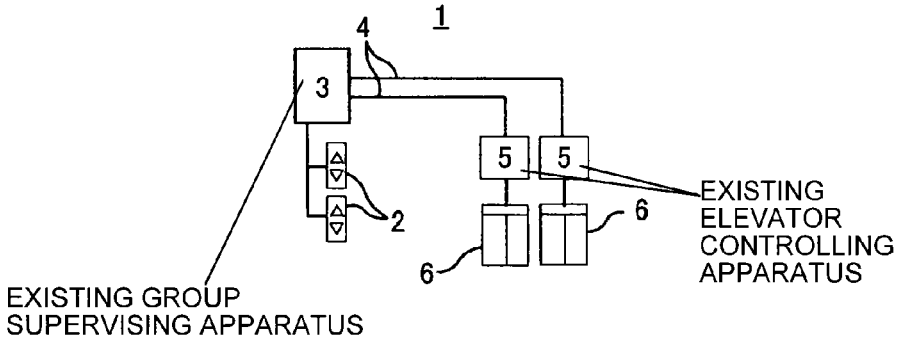
FIG. 1 is an elevator block diagram of a group supervised elevator to which an elevator renovating method according to the present invention can be applied; (Inventive Example 1)

An example of a group supervised elevator to which an elevator renovating method according to the present invention can be applied is shown in FIG. 1, before being refurbished. In FIG. 1, an existing elevator 1 that is to be renewed includes: an existing group supervising apparatus 3 that is connected to a plurality of existing landing operating panels 2; and a plurality of existing elevator cars 6 that are connected to existing elevator controlling apparatuses 5 that are respectively connected to the existing group supervising apparatus 3 by parallel wires 4. In an existing elevator 1 of this kind, the existing group supervising apparatus 3 allocates calls that are registered by the existing landing operating panels 2 to the existing elevator controlling apparatuses 5, and the existing elevator cars 6 are operated so as to be supervised as a group. In the depicted example, there are only two existing elevator cars 6, but the present invention can be used as a renovating method for elevators that have a plurality of existing elevator cars 6 that are supervised as a group.

Figure 2:
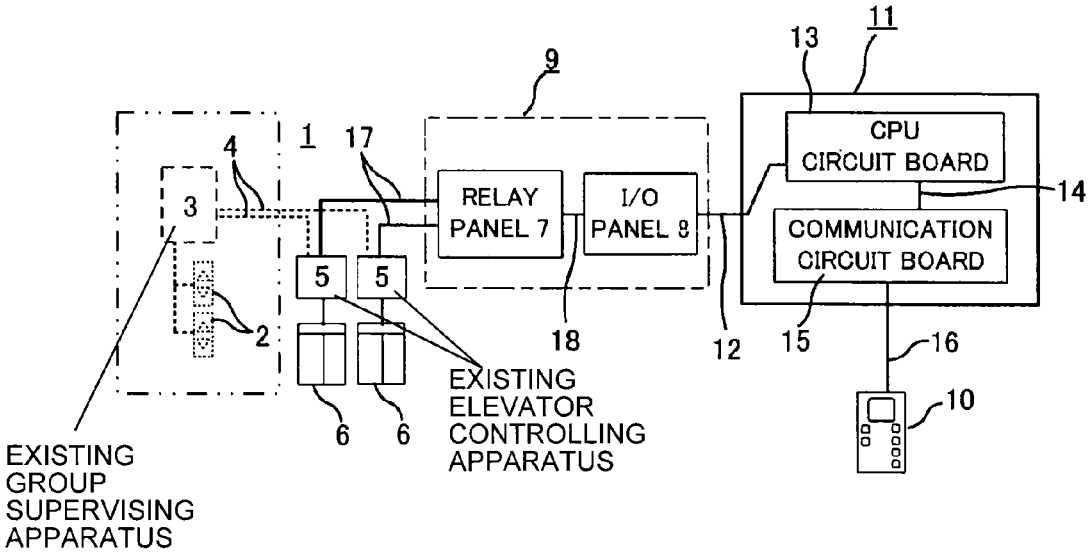
FIG. 2 is a block diagram that shows a state in which a new group supervising apparatus and new landing operating panels are connected by means of a relaying apparatus in the elevator from FIG. 1; (Inventive Example 1)
Figure 5:
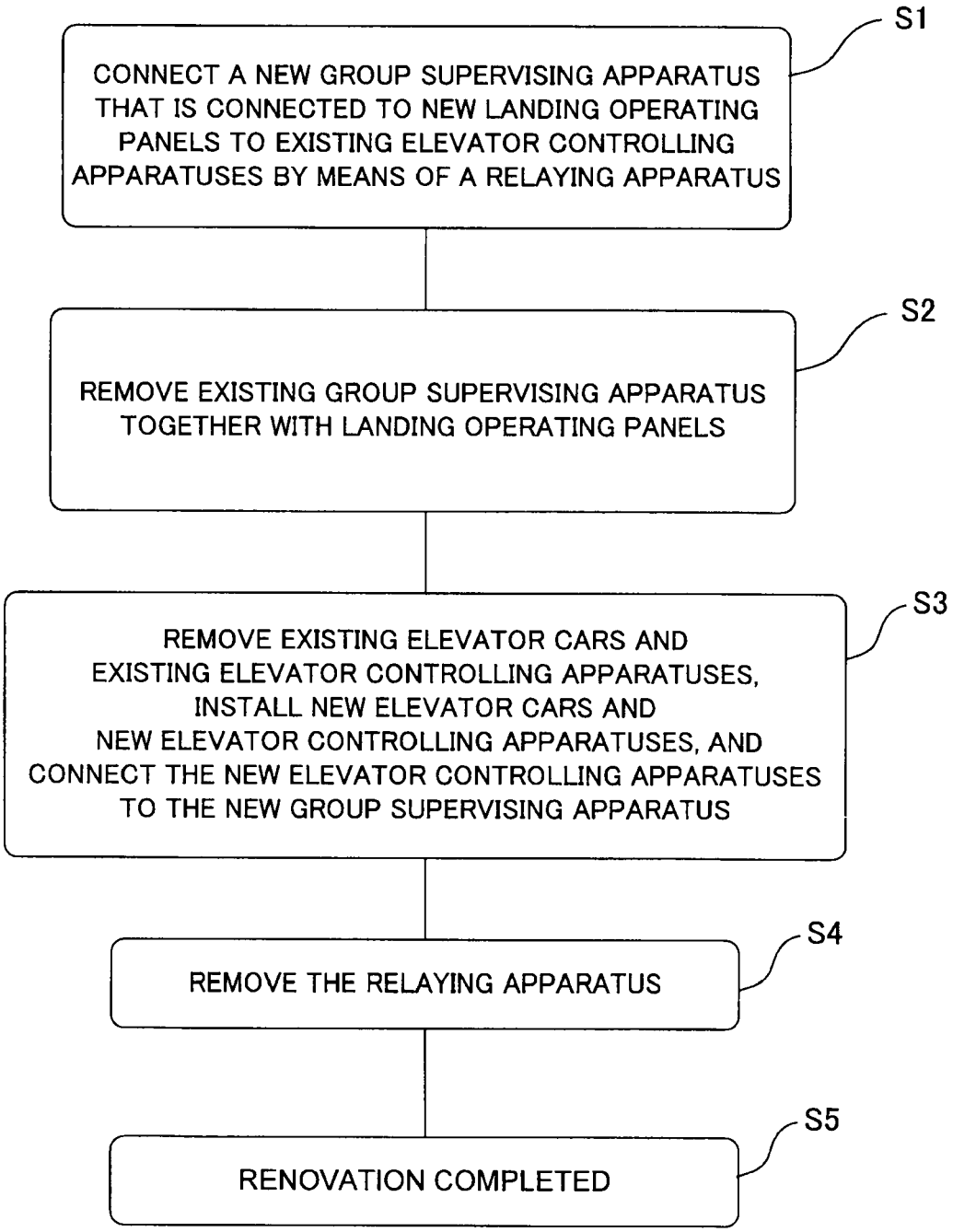
FIG. 5 is a flowchart that shows an elevator renovating method according to the present invention. (Inventive Example 1)

Next, as shown in FIG. 2, a new group supervising apparatus 11 that is connected to new landing operating panels 10 is connected to the existing elevator controlling apparatuses 5 that are shown in FIG. 1 by means of a relaying apparatus 9 that includes a relay panel 7 and an input/output (I/O) panel 8 to enable the existing elevator cars 6 to be operated by the new group supervising apparatus 11. This step is shown as step S1 in FIG. 5. At this point, the existing group supervising apparatus 3 can also be removed together with the existing landing operating panels 2. Alternatively, the new landing operating panels 10 can also be disposed at the same time by disposing them at positions that are separate from the positions at which the existing landing operating panels 2 are installed, at positions on opposite sides to the left and right of the landing doorway, for example, and the existing landing operating panels 2 and the new landing operating panels 10 can then be used selectively if it is necessary to perform the renovating work separately at night, etc. This state is refurbishment transition period 1, which is the first stage of the elevator renovating work.

The new group supervising apparatus 11 includes: a central processing unit (CPU) circuit board 13 that is connected to the I/O panel 8 of the relaying apparatus 9 by a serial wire 12; and a communications circuit board 15 that is connected by a serial wire 14 to the CPU circuit board 13, and the communications circuit board 15 is connected to the new landing operating panels 10 by serial wires 16. The relay panel 7 of the relaying apparatus and the existing elevator cars 6 are connected by parallel wires 17, and the relay panel 7 and the I/O panel 8 are connected by a parallel wire 18.

In the state that is shown in FIG. 2, the new group supervising apparatus 11 is installed in order to renovate the existing elevator 1 that is shown in FIG. 1, and the relaying apparatus 9, which includes the relay panel 7 and the I/O panel 8 for moving the existing elevator cars 6 using the new group supervising apparatus 11, is also installed. The relay panel 7 is designed to change signals such as calls to the existing elevator controlling apparatuses 5 to no-voltage contacts using relays in order to connect the existing elevator controlling apparatuses 5 and the new group supervising apparatus 11, and the I/O panel 8 installs an I/O circuit board for inputting and outputting the no-voltage contacts of the relay panel 7 to the new group supervising apparatus 11.

The new group supervising apparatus 11 communicates calls that are output from the new landing operating panels 10 using the communications circuit board 15 and the CPU circuit board 13, and outputs them from the I/O panel 8 to switch the relays of the relay panel 7 ON. By switching the relays of the relay panel 7 ON, call allocating signals, etc., can be outputted to the existing elevator controlling apparatuses 5 to operate the existing elevator cars 6.

Required signals from the existing elevator controlling apparatuses 5, such as position signals from the elevator cars 6, etc., are outputted to the relay panel 7, and the relay contacts of the relay panel 7 are inputted by the I/O panel 8. The existing elevator cars 6 can be controlled by communicating the inputted signals using the I/O panel 8 and the CPU circuit board 13, and inputting them to the new group supervising apparatus 11.

Thus, in the state in FIG. 2, since the new group supervising apparatus 11 and the existing elevator controlling apparatuses 5 are connected by the relaying apparatus 9 that includes the relay panel 7 and the I/O panel 8, the new group supervising apparatus 11 can operate the existing elevator cars 6 by group supervision, enabling the existing group supervising apparatus 3 and the existing landing operating panels 2 to be removed. This step is shown as step S2 in FIG. 5.

Consequently, time for which elevator operation must be stopped can be kept short even in the refurbishment transition periods in the elevator renovating work. In cases such as where the elevator renovating work may take several days, renovating work can also be performed exclusively at night when there are no passengers, and the existing elevator cars 6 can be controlled and operated by the new group supervising apparatus 11 and the new landing operating panels 10 in the daytime, when services are required for passengers, enabling substantial deterioration in elevator operating efficiency to be prevented.

Figure 3:
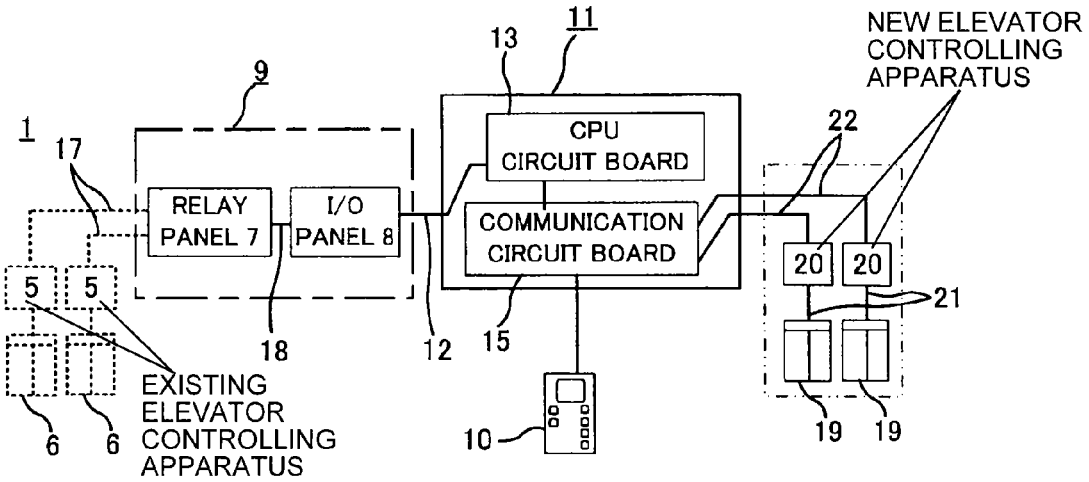
FIG. 3 is a block diagram that shows a state in which old group supervising apparatuses and old landing operating panels are removed from the elevator in FIG. 2, and new elevator cars are connected together with new elevator controlling apparatuses; (Inventive Example 1)

In FIG. 3, a state is shown in which new elevator controlling apparatuses 20 to which new elevator cars 19 are respectively connected are connected to the new group supervising apparatus 11 that is shown in FIG. 2 such that the new elevator cars 19 can be operated by the new group supervising apparatus 11. Because the existing elevator controlling apparatuses 5 and the existing elevator cars 6 are removed at this stage, as will be explained later, they are indicated by imaginary lines. This state is refurbishment transition period 2, which is the second stage of the elevator renovating work.

In FIG. 3, because the existing elevator cars 6 can be operated by the new group supervising apparatus 11 and the new landing operating panels 10 that are installed in refurbishment transition period 1 as shown in FIG. 2, any one of this plurality of existing elevator cars 6 can be removed together with the corresponding existing elevator controlling apparatus 5, and be replaced by installing a new elevator car 19 and a new elevator controlling apparatus 20. The new elevator car 19 that is newly installed is connected to the new elevator controlling apparatus 20 by a serial wire 21, and this new elevator controlling apparatus 20 is connected to the communications circuit board 15 of the new group supervising apparatus 11 by a serial wire 22. If this replacement operation is performed one at a time and repeated for the number of elevator cars, the new elevator cars 19 that are installed in place of the existing elevator cars 6 can be operated by the new group supervising apparatus 11. This step is shown as step S3 in FIG. 5.

Figure 4:
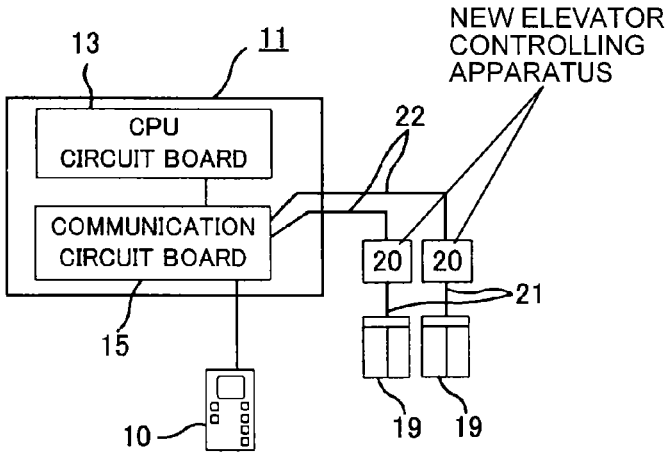
FIG. 4 is an elevator block diagram according to the present invention that shows a state in which a relaying apparatus and old elevator cars are removed from the elevator in FIG. 3 together with old controlling apparatuses to complete renovation; (Inventive Example 1)

FIG. 4 shows a state in which all of the existing elevator cars 6 have been updated together with the corresponding existing elevator controlling apparatuses 5 by new elevator cars 19 and new elevator controlling apparatuses 20 in this manner. As shown in FIG. 4, when all of the renovating work is completed, calls that are registered by the new landing operating panels 10 are allocated to the new elevator controlling apparatuses 20 by the new group supervising apparatus 11, enabling the new elevator cars 19 to be operated by group supervision. The relaying apparatus 9 that includes the relay panel 7 and the I/O panel 8, which are no longer required, is removed. Because this relaying apparatus 9 can also be used in a similar manner as a tool for renovating and refurbishing work in refurbishing work at other sites, the elevator refurbishing method can also be said to be considerate of the environment since it is not necessary to manufacture them for each site. This step is shown as step S4 in FIG. 5, and when removal of the relaying apparatus 9 is finished, the elevator renovating work is completed (step S5 in FIG. 5).

As is clear from the above explanation, by the elevator renovating method according to the present invention, elevators under group supervision of a new system can be replaced during renovating work without losing overall elevator service, enabling renovation to new elevators without having to lower elevator operating efficiency by stopping the elevators for a long time.

The apparatus that is depicted and explained above is merely an example and many kinds of variations are possible, and features of respective specific examples can also be used altogether or selectively in combination with each other.

INDUSTRIAL APPLICABILITY

The present invention can be used in an elevator renovating method.

EXPLANATION OF NUMBERING

1 ELEVATOR, 2 EXISTING LANDING OPERATING PANEL, 3 EXISTING GROUP SUPERVISING APPARATUS, 4 PARALLEL WIRE, 5 EXISTING ELEVATOR CONTROLLING APPARATUS, 6 EXISTING ELEVATOR CAR, 7 RELAY PANEL, 8 I/O PANEL, 9 RELAYING APPARATUS, 10 NEW LANDING OPERATING PANEL, 11 NEW GROUP SUPERVISING APPARATUS, 12 SERIAL WIRE, 13 CPU CIRCUIT BOARD, 14 SERIAL WIRE, 15 COMMUNICATIONS CIRCUIT BOARD, 16 SERIAL WIRE, 17 PARALLEL WIRE, 18 PARALLEL WIRE, 19 NEW ELEVATOR CAR, 20 NEW ELEVATOR CONTROLLING APPARATUS, 21 SERIAL WIRE, 22 SERIAL WIRE.

The invention claimed is:

1. An elevator renovating method for renovating an existing elevator comprising:

an existing group supervising apparatus that is connected to a plurality of landing operating panels; and a plurality of existing elevator cars that are connected to respective existing elevator controlling apparatuses that are connected to said existing group supervising apparatus, the elevator renovating method comprising:

connecting a relaying apparatus, which is connected to new landing operating panels and a new group supervising apparatus with the new group supervising apparatus connected between the relaying apparatus and the new landing operating panels, to the respective existing elevator controlling apparatuses to enable operation of the existing elevator cars by the new group supervising apparatus through a relay panel and an input/output panel of the relaying panel, and according to operations of the new landing operating panels without operating the existing group supervising apparatus; and disconnecting the existing group supervising apparatus from the respective elevator controlling apparatuses, connecting new elevator cars and new elevator controlling apparatuses to the new group supervising apparatus to enable operation of the new elevator cars with the new group supervising apparatus according to the operations of the new landing operating panels before or after disconnecting the respective existing elevator controlling apparatuses and the exiting elevator cars from the new group supervising apparatus.

2. The elevator renovating method according to claim 1, further comprising removing the relaying apparatus after connecting the new elevator controlling apparatuses to the new group supervising apparatus.

3. The elevator renovating method according to claim 1, wherein the relay panel connects to the respective existing elevator controlling apparatuses and the new group supervising apparatus and changes signals including calls to the respective existing elevator controlling apparatuses into no-voltage contacts using relays, and wherein said input/output panel includes an input/output circuit board for inputting and outputting the no-voltage contacts of the relay panel to the new group supervising apparatus.

4. The elevator renovating method according to claim 1, wherein the new group supervising apparatus communicates with the relaying apparatus through a communications circuit board and a CPU circuit board, and outputs from the communications circuit board, calls that are output from the new landing operating panels to output call allocating signals to the respective existing elevator controlling apparatuses and operate the existing elevator cars by switching the relays of the relay panel ON.

* * * * *